US010987699B2

(12) United States Patent
Sánchez Rodríguez

(10) Patent No.: US 10,987,699 B2
(45) Date of Patent: Apr. 27, 2021

(54) DENSITY SEPARATOR FOR WASTE MATERIAL

(71) Applicant: Jesús Sánchez Rodríguez, Barcelona (ES)

(72) Inventor: Jesús Sánchez Rodríguez, Barcelona (ES)

( * ) Notice: Subject to any disclaimer, the term of this patent is extended or adjusted under 35 U.S.C. 154(b) by 60 days.

(21) Appl. No.: 16/348,354

(22) PCT Filed: Nov. 8, 2016

(86) PCT No.: PCT/ES2016/070792
§ 371 (c)(1),
(2) Date: May 8, 2019

(87) PCT Pub. No.: WO2018/087403
PCT Pub. Date: May 17, 2018

(65) Prior Publication Data
US 2020/0147651 A1 May 14, 2020

(51) Int. Cl.
*B07B 9/00* (2006.01)
*B03D 1/14* (2006.01)
(Continued)

(52) U.S. Cl.
CPC ..... *B07B 9/00* (2013.01); *B03D 1/1462* (2013.01); *B03D 1/1468* (2013.01); *B03D 1/242* (2013.01); *B07B 4/08* (2013.01)

(58) Field of Classification Search
CPC .... B07B 9/00; B07B 4/08; B07B 1/00; B07B 4/02; B07B 4/025; B07B 4/04;
(Continued)

(56) References Cited

U.S. PATENT DOCUMENTS 3,756,405 A * 9/1973 Fenska ..... B07B 4/08 209/44.2
3,822,015 A * 7/1974 Hsieh ..... B03B 5/28 209/173
(Continued)

FOREIGN PATENT DOCUMENTS

ES 1057852 U 12/2005

*Primary Examiner* — Patrick H Mackey
(74) *Attorney, Agent, or Firm* — Hayes Soloway PC

(57) ABSTRACT

The separator according to the invention comprises: a tank (1) for receiving waste material and containing fluid to separate waste material by density into floating and settled material; automatic feed means (18, 37), for example, a double screen (18) to feed waste material to the tank (1); motorised conveyor belts (3, 4) divided into a floating waste material conveyor (3) and a settled waste material conveyor (4) to extract floating or settled waste material from the tank (1): and a blower-type sorting device (21) comprising: a turbine (22) that provides an airflow; and a branched duct (23) divided into: a riser duct (26) to transport part of the airflow to a diffuser (39) beneath the automatic feed means (18, 37) to raise light-weight waste material; and a discharge duct (27) to transport and horizontally expel another part of the airflow in order to remove previously raised waste material. The separator according to the invention may incorporate bubble-making means, with injectors (2) to facilitate floatability and remove floating waste material.

20 Claims, 9 Drawing Sheets

(51) Int. Cl.
*B03D 1/24* (2006.01)
*B07B 4/08* (2006.01)

(58) Field of Classification Search
CPC .... B03D 1/1462; B03D 1/1468; B03D 1/242; B03B 5/623; B03B 11/00; B03B 5/36
See application file for complete search history.

(56) References Cited

U.S. PATENT DOCUMENTS

| | | | | | |
|---|---|---|---|---|---|
| 4,465,194 | A * | 8/1984 | Coleman | A24B 5/10 | 209/138 |
| 4,631,124 | A * | 12/1986 | Paulson | B07B 4/02 | 209/134 |
| 5,110,454 | A * | 5/1992 | Parker | B03B 7/00 | 209/155 |
| 7,017,753 | B2 * | 3/2006 | Tse | B03B 5/40 | 209/162 |
| 7,775,371 | B2 * | 8/2010 | Torres | B03B 11/00 | 209/172 |
| 8,524,089 | B2 * | 9/2013 | Tsai | B03D 1/247 | 210/703 |
| 9,174,856 | B2 * | 11/2015 | Matsufuji | B03D 1/1475 | |
| 2004/0035757 | A1 | 2/2004 | Vandeputte | | |
| 2004/0134395 | A1 | 7/2004 | Eberhardt et al. | | |
| 2008/0121574 | A1 | 5/2008 | Sanchez Torres | | |
| 2009/0065404 | A1 | 3/2009 | Paspek, Jr. et al. | | |
| 2009/0188844 | A1 | 7/2009 | Davis et al. | | |

* cited by examiner

DENSITY SEPARATOR FOR WASTE MATERIAL

CROSS-REFERENCE TO RELATED APPLICATIONS AND PRIORITY

This patent application claims priority from PCT Patent Application No. PCT/ES2016/070792 filed Nov. 8, 2016. This patent application is herein incorporated by reference in its entirety.

OBJECT OF THE INVENTION

The present invention can be included in the technical field of material, particularly solid material separation. More specifically, the object of the invention relates to a density-type separator for waste material, that is, it separates waste material, particularly rubble, according to its density.

BACKGROUND OF THE INVENTION

The applicant is also the owner of Spanish utility models with application numbers U200401407 and U200602591, as well as United States patent U.S. Pat. No. 7,775,371.

Said utility model and patent documents describe respective devices for separating waste material, rubble in particular, according to the density of the components of the waste material.

In particular, U200401407 relates to a separator with a tank filled with water for receiving the rubble through a feed chute and separating the waste material by flotation. Floating, that is, lower density, waste material such as papers, plastics, woods, etc., are removed through a first conveyor belt, which churns the surface of the water to bring the waste material closer to the first conveyor belt. Moreover, the denser waste material sinks and settles at the bottom, where a second conveyor belt collects it and takes it out of the tank.

In turn, U200602591 and U.S. Pat. No. 7,775,371 incorporate improvements with respect to U200401407. In particular, U200602591 additionally comprises a vibrating screen preceding the feed chute and the tank, which can be a single screen (that is, allowing only the coarsest or only the finest material to pass through), or a double screen (that is, filtering out both the finest and the coarsest material to allow only the intermediate material to pass through) to pre-select the waste material before being admitted into the tank, preventing the finest material (grit and the like) from accessing the tank and leaving behind silt, sludge and the like. To prevent the build-up of sludge, it also has a third conveyor belt which removes the settled waste material, where sprinklers are preferably arranged above the third belt to wash the waste material. The incorporation of a plenum to remove plastic waste material by blowing air is also contemplated.

DESCRIPTION OF THE INVENTION

The present invention describes a density separator for waste material which incorporates improvements and additional advantages in relation to utility models U200401407 and U200602591 and patent U.S. Pat. No. 7,775,371 referred to above in the background and incorporated herein by reference.

In particular, the density separator of the invention comprises a tank intended for containing a fluid to separate waste material by density into floating waste material and settled waste material.

The separator further comprises automatic feed means, such as a vibrating screen, for example, to feed waste material to the tank. In a preferred optional manner, a waste material chute is additionally arranged sandwiched between the automatic feed means and the tank in order to be fed from said automatic feed means and in turn to feed the tank.

Motorised conveyor belts are additionally arranged to remove waste material from the tank, each one with a chassis and a conveyor belt, and which in turn comprise:

- a floating waste material conveyor to extract floating waste material from the surface of the water; and
- a settled waste material conveyor to extract settled waste material from the bottom of the tank.

Advantageously, the separator further comprises a blower-type sorting device, which in turn comprises:

- an air turbine that provides an airflow;
- a duct which receives the airflow from the turbine and branches into a riser duct and a discharge duct; and
- a diffuser located below the automatic feed means and communicated with the riser duct to receive a first part of the airflow of the turbine and cause air to be expelled in the vertical or inclined direction, which raises more light-weight waste material (bags, PET bottles, papers), where the discharge duct moreover transports a second part of the airflow, which causes air to be horizontally expelled to remove the light-weight waste material—once it is raised by means of the first flow—to a lateral pipe, preventing interferences with other heavier fractions of waste material.

One of the improvements referred to above relates to the incorporation of submerged bubble-making means which preferably cover the entire width of the tank to generate bubbles which facilitate flotation of the more light-weight material. Bubbling reduces the time the more light-weight materials remain in contact with the water, which on one hand entails greater speed in removing the more light-weight materials, and on the other hand lower contamination of the water used, as well as lower water consumption, because it does not absorb as much water.

Another one of the improvements relates to the aforementioned plenum. The present invention incorporates a blower-type sorting device, comprising an air turbine which supplies an airflow through a duct which branches into two ducts. Therefore, the blown air branches into two paths. A first path transports a first part of the flow, which causes air to be vertically expelled to raise the light-weight waste material before accessing the tank; whereas a second path transports a second part of the airflow, which causes air to be horizontally expelled to remove the light-weight waste material—once it is raised by means of the first flow—to a lateral pipe, thereby preventing interferences with other heavier fractions of waste material.

Other improvements will be described below in the section providing a description of a preferred embodiment.

DESCRIPTION OF THE DRAWINGS

To complement the description that is being made and for the purpose of helping to better understand the features of the invention according to a preferred practical embodiment thereof, in which a set of drawings depicting the following in an illustrative and non-limiting manner is attached as an integral part of said description.

PREFERRED EMBODIMENT OF THE INVENTION

Figure 1:
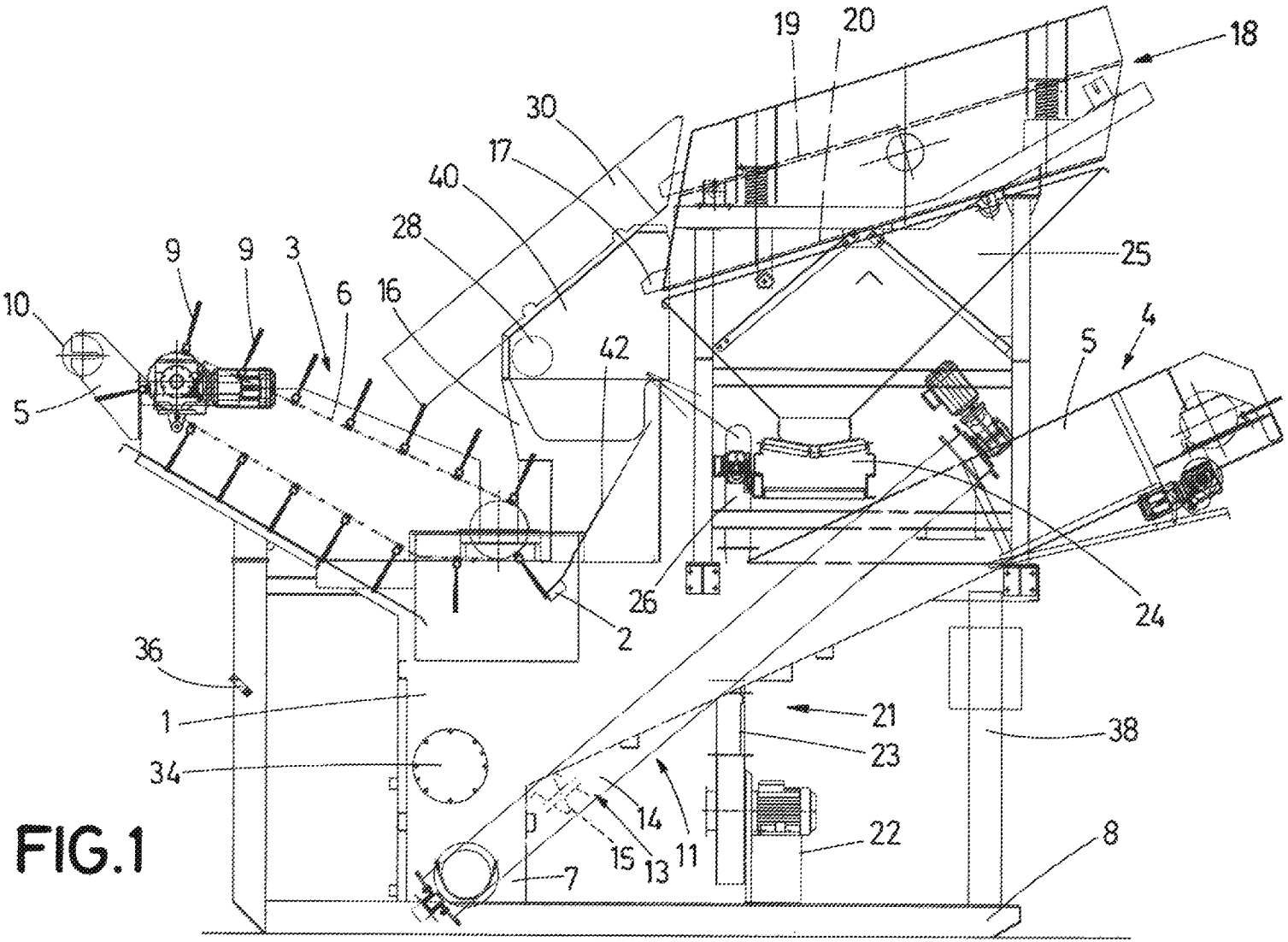
FIG. 1 shows a lateral view of the density separator for waste material according to the present invention.
Figure 2:
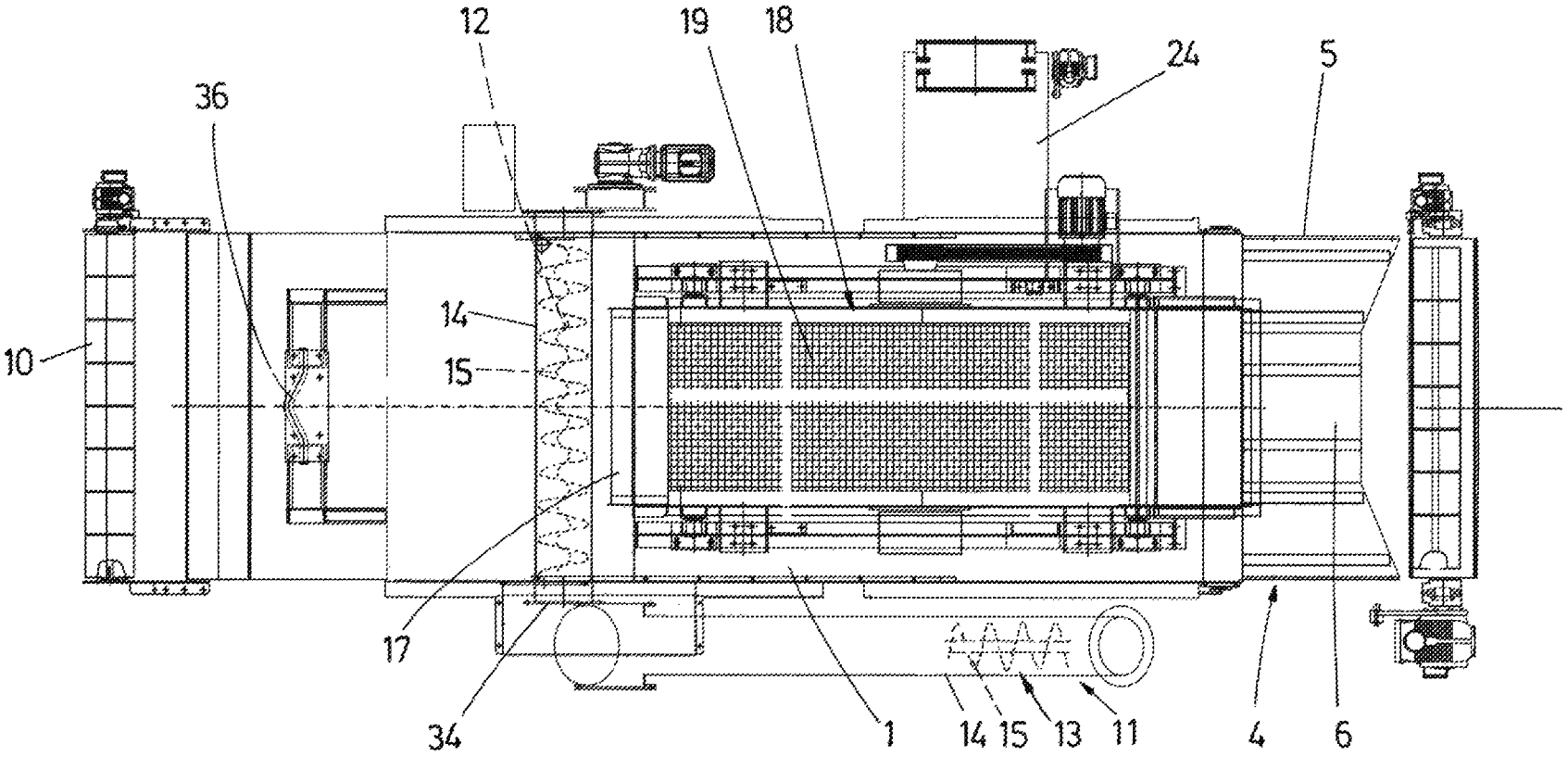
FIG. 2 shows a top view of the density separator of FIG. 1.
Figure 3:
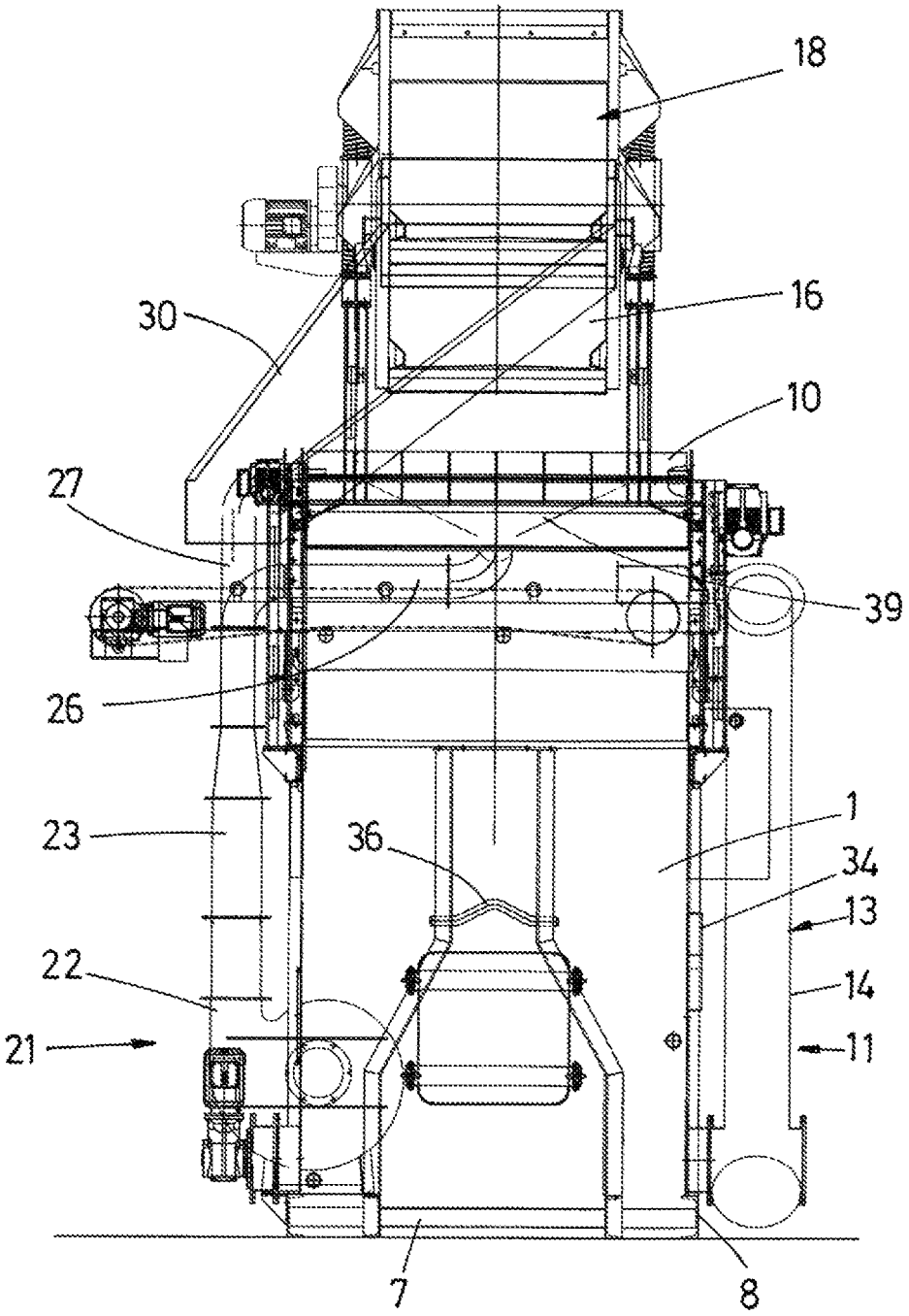
FIG. 3 shows a front view of the density separator from the left side of FIGS. 1 and 2.
Figure 4:
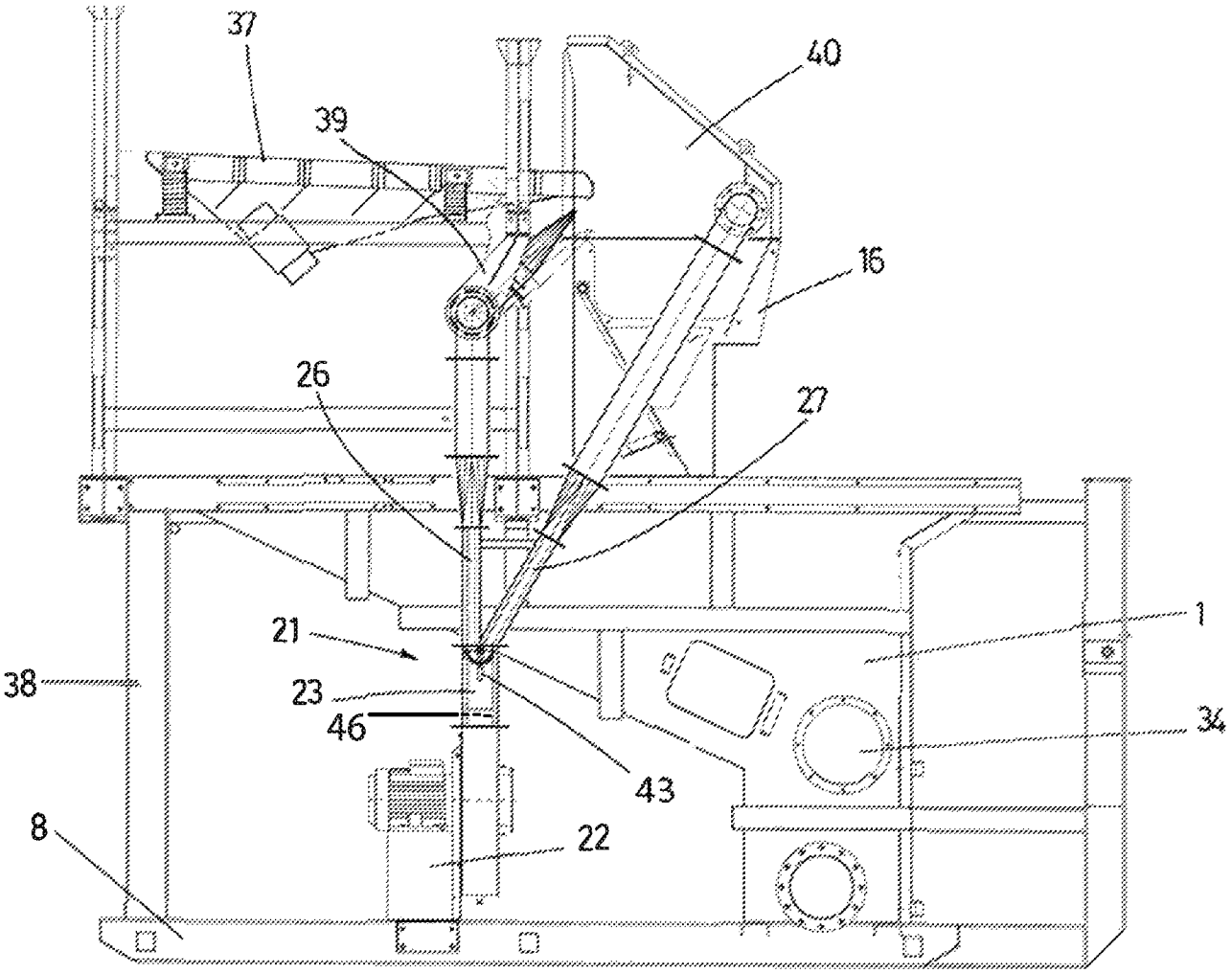
FIG. 4 shows a lateral view of a detail of the blower-type sorting device from the side opposite that of FIG. 1.
Figure 5:
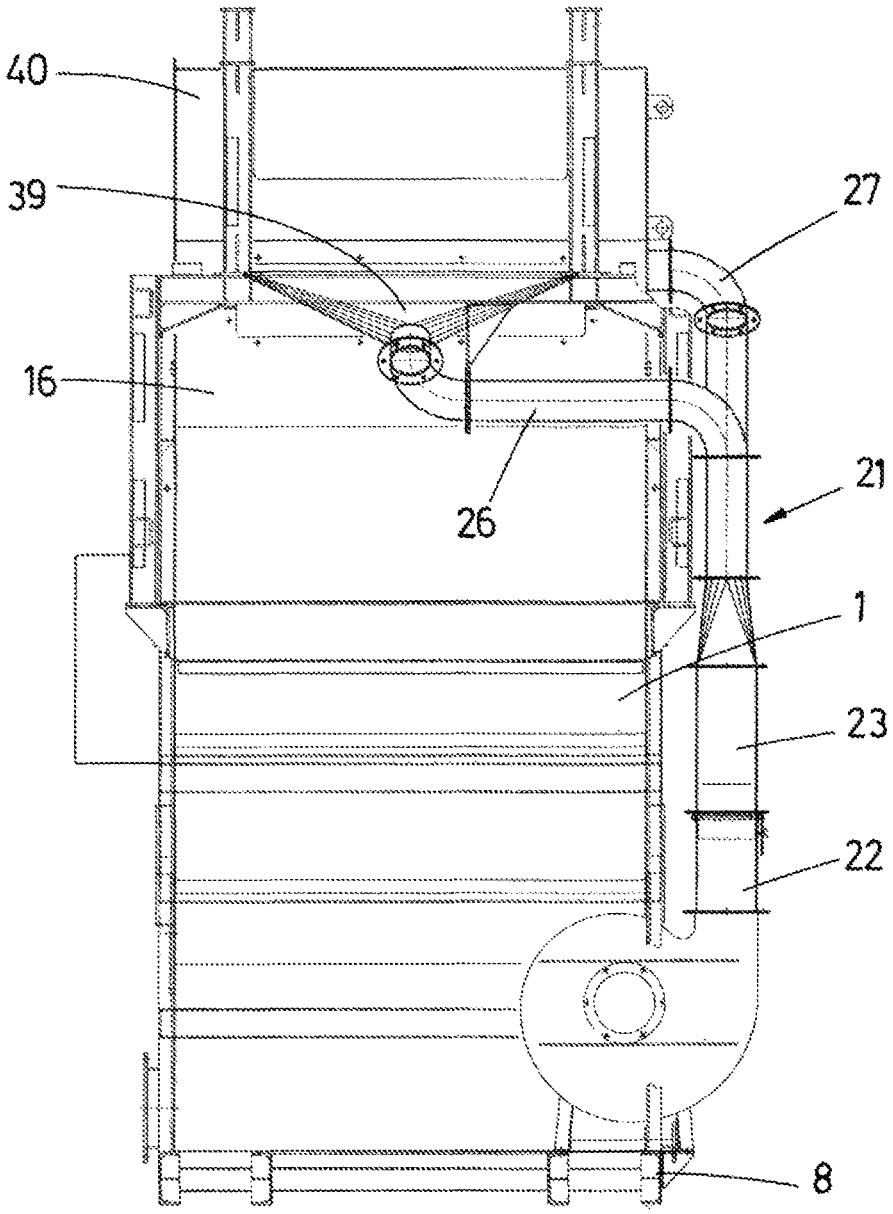
FIG. 5 shows a front view of a detail of the blower-type sorting device from the side opposite that of FIG. 3.
Figure 6:
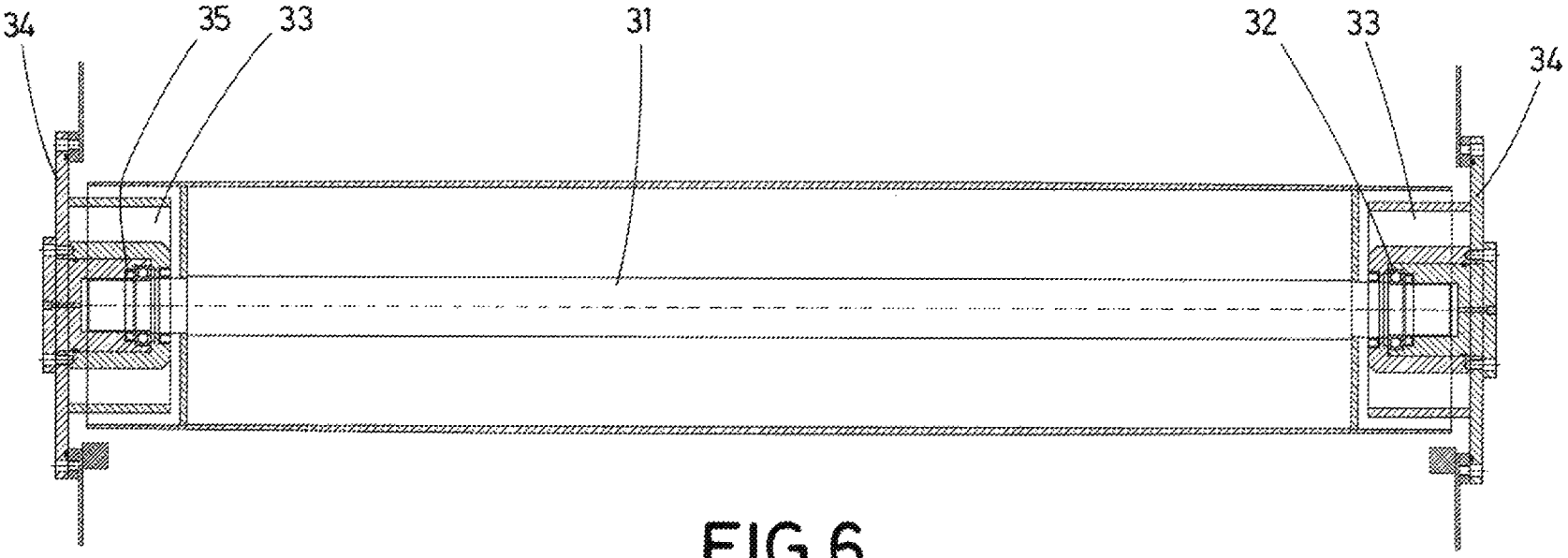
FIG. 6 shows a detailed view of a housing made in the tank to house a shaft of the settled waste material conveyor.
Figure 7:
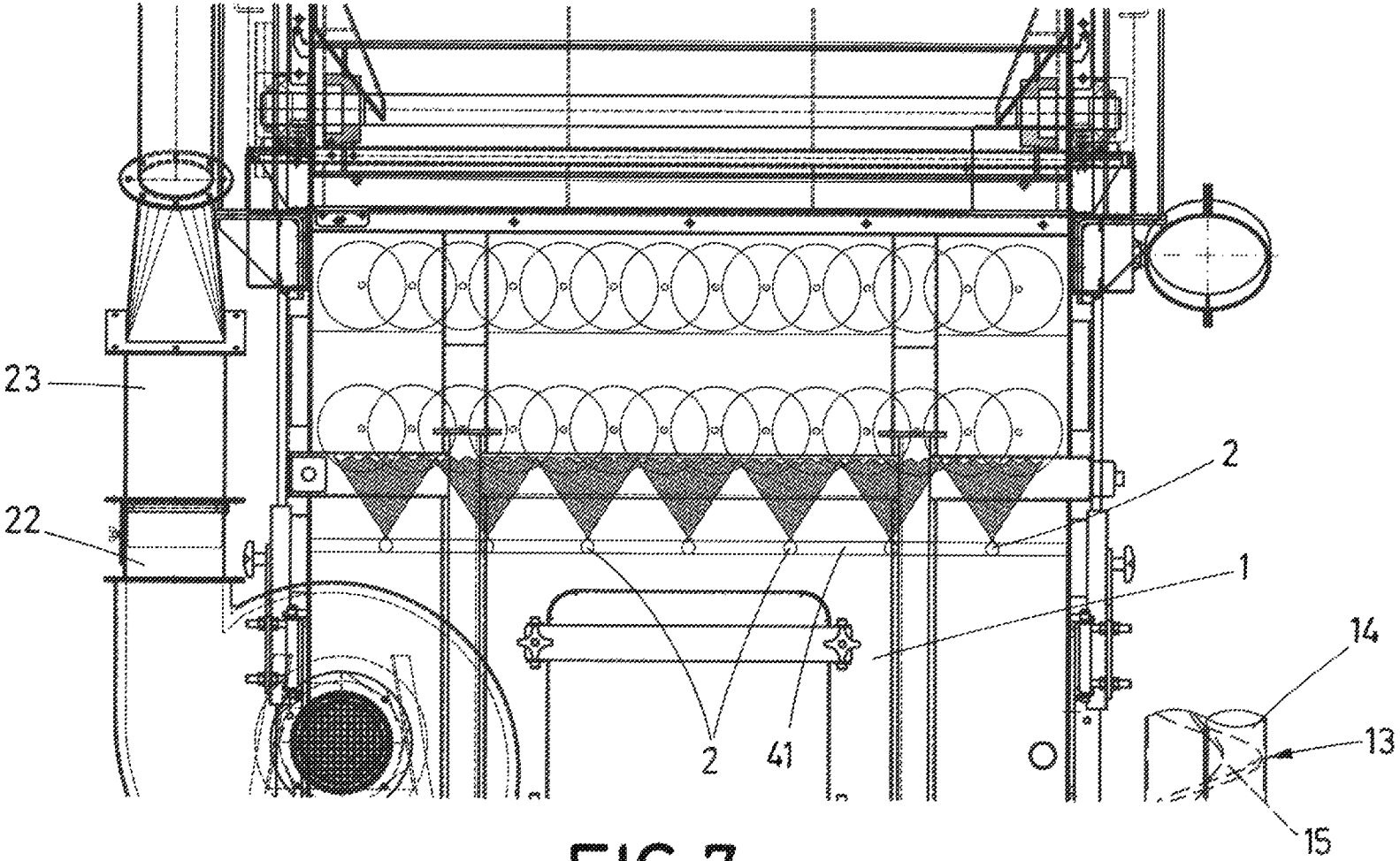
FIG. 7 shows a detailed view of bubble-making means provided with bubble injectors to inject air bubbles into the tank and help float the floating waste material.
Figure 8:
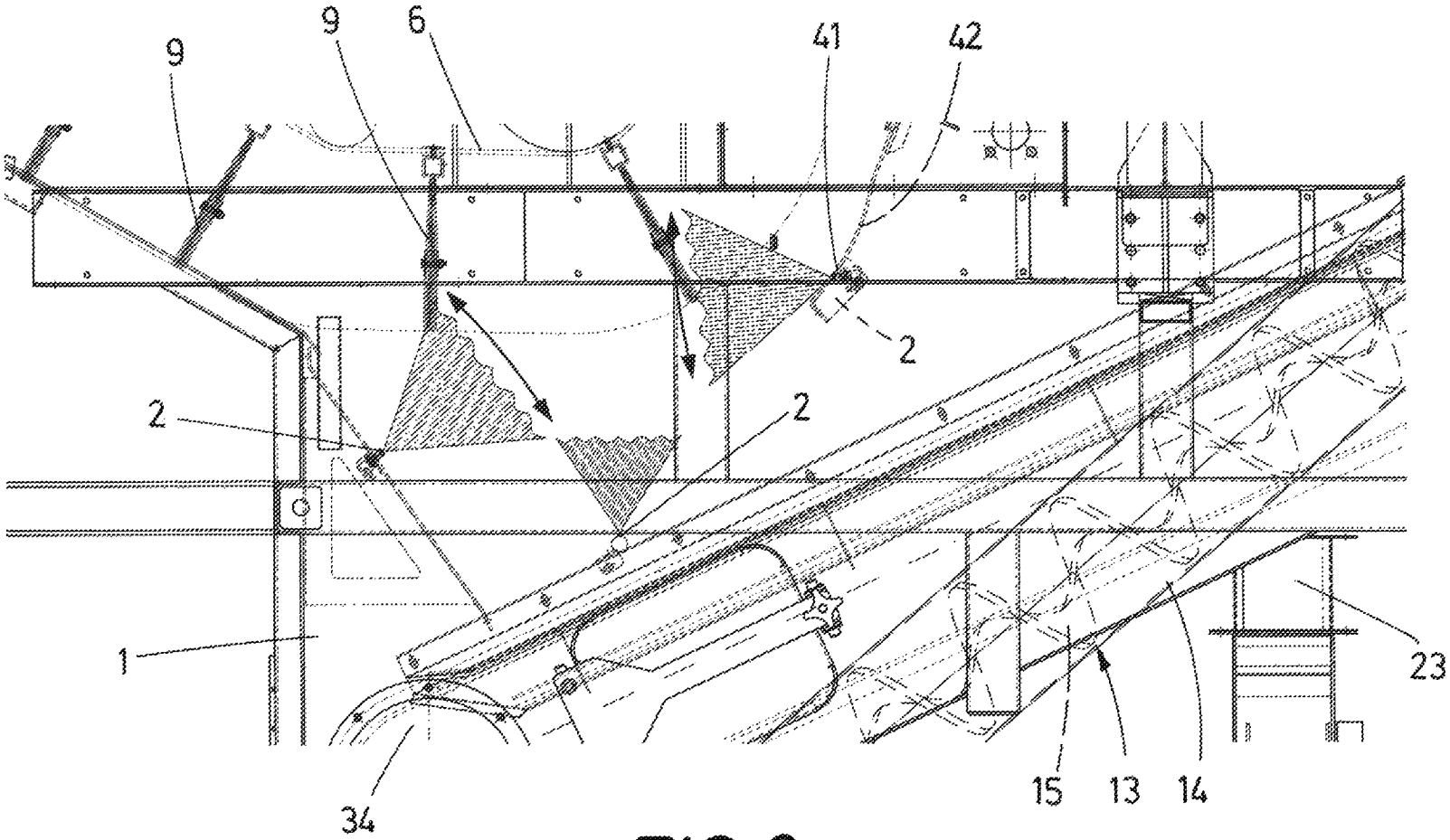
FIG. 8 shows an additional detail of the position of the injectors.
Figure 9:
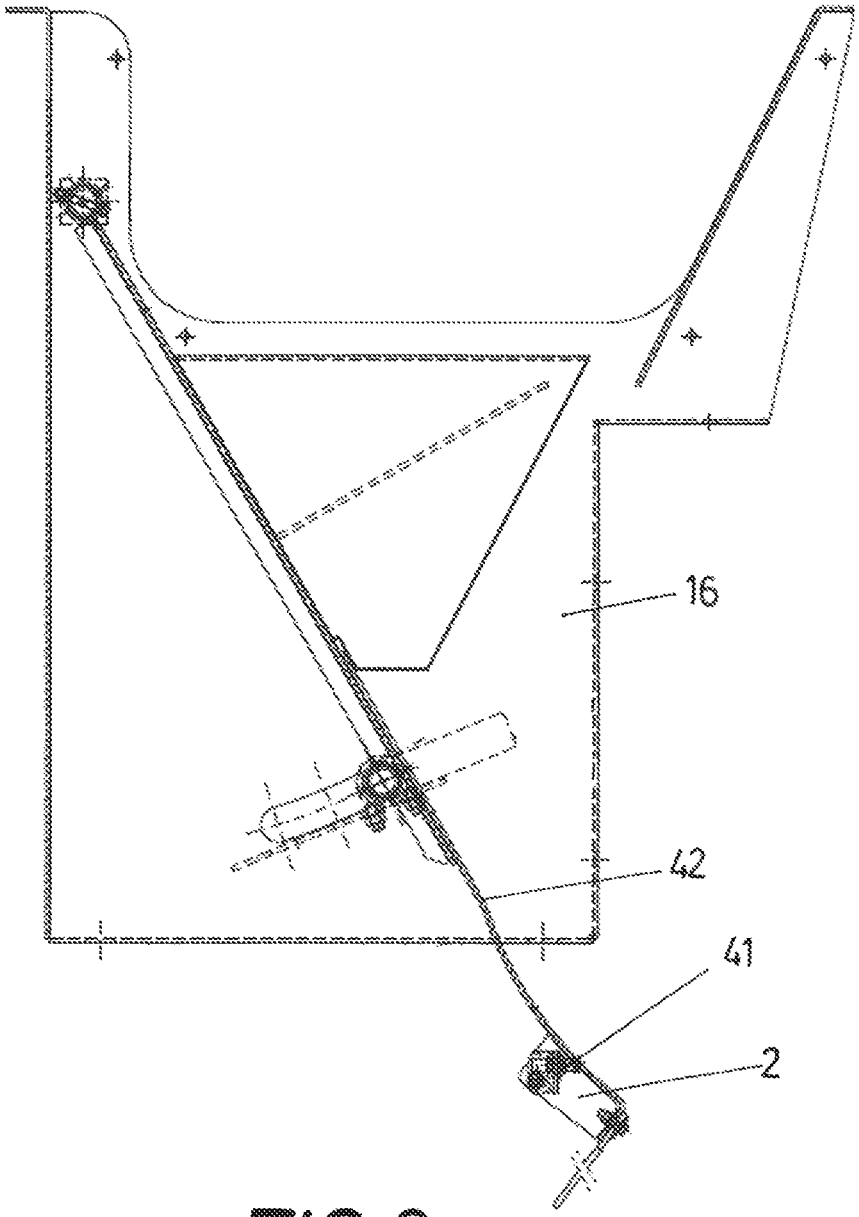
FIG. 9 shows a detail of the location of the supports on which the injectors are supported.

A detailed description of an embodiment of a density separator for waste material object of the present invention is shown below with the aid of attached FIGS. 1 to 9 mentioned above.

The density separator for waste material of the invention is particularly indicated to separate rubble from construction works, in particular to first remove the more light-weight and less bulky materials, such as papers, plastic bottles and bags; next, less light-weight but not heavy components, such as woods, cardboards, strapping and hard plastics or inert materials; and finally, among the heavier materials (construction materials per se), separate the materials being the largest in diameter (stones, debris) from those that are the smallest in diameter (grit, fines and sludge).

The separator comprises a tank (1) filled with a liquid, for example water, the density of which serves as a reference for separating a mixture of rubble and impurities by floating and settling, the tank incorporating one or more filling and emptying ducts together with the corresponding non-depicted shut-off cocks. The tank (1) has an elevational section, which preferably is essentially triangular, where in its lower part the tank (1) has a base (7) located at one end, and equipped with a cross section of smaller dimensions, where the cross section increases from the base (7) to the upper part. Accordingly, the tank (1) is supported by a frame which preferably, as illustrated in the figures, comprises a platform (8) and a portal frame (38) opposite the base (7).

Bubble-making means are additionally arranged to bubble air inside the tank (1). Preferably, the bubble-making means comprise at least one, preferably a plurality, of injectors (2) inside the tank (1) to provide pressure and direction to the bubbles. The air bubbles pull the floating waste material that accessed the tank (1) to the surface of the water, aiding their floatability. Preferably, the injectors (2) are assembled in a preferably horizontal injection tube (41) oriented along the width of the tank (1). Also preferably, the injectors (2), where appropriate with the injection tube (41), are supported on one or several supports (42) emerging from a waste material chute (16) which can be arranged optionally and will be described below.

Inside the tank (1) there are respective motorised conveyor belts (3, 4) which are floating material conveyor belts (3) and settled material conveyor belts (4), with their respective chassis (5) and corresponding conveyor belt (6), to extract waste material from the tank (1), in particular to respectively extract floating materials on one side and settled materials on the other. The conveyor belt (6) of the floating waste material conveyor (3) can incorporate projecting brushes (9) to clean the wall of the tank (1) and also to retain the floating material, given that due to its lower density it may not go along with the movement of the conveyor belt (6). Additionally, in the chassis (5) of the floating waste material conveyor (3), preferably at the outermost end, a retainer (10), preferably a rotating roller, is assembled contacting with the brushes (9) upon passage thereof to free the brushes (9) of impurities which fall out of the tank (1).

A bottom cleaner (11) is also included for the purpose of preventing or delaying the silting of the tank (1). According to a less preferred and therefore not depicted embodiment, as described in document U200602591, the bottom cleaner (11) may comprise a motorised belt conveyor, with a conveyor belt, optionally equipped with lower transverse projections which collect and pull sludge deposited at the bottom of the tank (1) against a corresponding side wall of said tank (1) suitably inclined towards the exterior.

Alternatively, according to a more preferred embodiment depicted in the figures, the bottom cleaner (11) preferably comprises a first worm screw (12) and a second worm screw (13). At least the second worm screw (13), preferably both worm screws (12, 13), comprise a casing (14) and at least one coaxially rotating vane (15) with its corresponding casing (14). It is preferable for the vane (15) or vanes (15) of at least one of the worm screws (12, 13), preferably of both worm screws (12, 13), not to have a physical shaft so on one hand it may dispose of more space, which allows a higher load capacity, and, where appropriate, may pull with it larger bodies, and on the other hand, as explained below, to advantageously facilitate draining the water accompanying the collected waste material, contrary to what occurs in U200602591. In particular, in a preferred embodiment of worm screws (12, 13) without a physical shaft, the vane (15) or vanes (15) are helical-shaped and cover a larger span corresponding to a helix pitch. There may be a single vane (15) or several vanes (15) consecutively fixed in the longitudinal direction of the casing (14).

The first worm screw (12) runs along the bottom of the tank (1), preferably horizontally, whereas the second worm screw (13) is installed outside the tank (1) and is inclined to collect in the lower part the waste material transported by the first worm screw (12) and raise said waste material for its subsequent disposal. The waste material transported by the second worm screw (13) dries as it is being raised, since much of the water accompanying it drains off by gravity through a clearance existing between the casing (14) and the vane (15) or vanes (15), and also through the centre due to the absence of a physical shaft, as discussed above.

As a consequence, water is saved because that water which would otherwise leave the tank (1) together with the waste material does not have to be replenished. The waste material is additionally dried. Moreover, the risk of jamming is also reduced because the absence of a physical central shaft provides more available space to load larger-sized waste material.

As mentioned above, the tank (1) can preferably receive waste material from a waste material chute (16). The waste material chute (16) can be fed automatically, through a feed conveyor (17), from automatic feed means (18, 37); the automatic feed means (18, 37) may comprise, for example, a vibrating screen (18) which, in the embodiment shown in the figures, is a double screen (18), but it can also be a single screen, intended to selectively allow access of the waste material to the tank (1), depending on its size, for example, by performing a pre-separation of: on one hand, coarser waste material which therefore is not readily extracted by the settled waste material conveyor (4); and on the other hand, the small-sized residues (primarily sand) which tend to form sludge which silts up the tank (1).

A non-depicted single screen comprises a single vibrating tray separating the larger-sized materials from smaller-sized materials. A double screen (18) like the one depicted comprises two inclined vibrating trays (19, 20), one of them being an upper tray (19) and the other one a lower tray (20). The upper tray (19) has a larger passage opening size to retain larger-sized residues, which are disposed of and therefore do not access the tank (1). In turn, the lower tray (20) has a smaller passage opening size to retain intermediate-sized residues, which access the tank (1), whereas the lower tray (20) allows smaller-sized residues, such as sand and the like, to pass through, which are taken out and therefore do not access the tank (1).

As a complement to separation by screening performed in the screen (18) and the separation by flotation performed in the tank (1), the invention also provides for the implementation of a blower-type sorting device (21) which acts in the area of the screen (1) and comprises an air turbine (22) which supplies an airflow through a corresponding duct (23). The duct (23) branches into a riser duct (26) and a discharge duct (27) to divide the airflow coming from the turbine (22) into a first part and a second part.

The riser duct (26) transports the first part to a diffuser (39) located below the automatic feed means (18, 37), for example the screen (18), to cause air to be expelled vertically or in the inclined direction, for example to an air chute (40), to raise more light-weight waste material (bags, PET bottles, papers).

In turn, the discharge duct (27) transports the second part, for example to the opposite end of the air chute (40), which causes air to be horizontally expelled to remove the light-weight waste material—once it is raised by means of the first flow—to a lateral pipe (28), thereby preventing interferences with other heavier fractions of waste material. The lateral pipe (28) comes out on a side, creating an autonomous separation for the floating material.

A control element (46) assembled in the duct (23) allows controlling the total flow circulating through the duct (23), as well as the rate of said flow total which is diverted into the first flow and the second flow.

Next, the removal of the waste material separated by the screen (18) is described. On one hand, a preferably non-motorised lateral conveyor (30) has been arranged to remove the larger-sized waste material retained in the upper tray (19) of the screen (18) which, due to the effect of vibration, falls laterally onto said lateral conveyor (30) by gravity, given that the upper tray (19) is inclined. Moreover, the finer-sized waste material (grit, fines and sludge) going through the lower tray (20) are collected by a fines collector (25) to a fines belt (24), which removes the fines. Finally, the intermediate-sized waste material retained in the lower tray (20) accesses the tank (1), preferably through the aforementioned feed conveyor (17), for example, going through the waste material chute (16).

The settled waste material conveyor (4) incorporates a shaft (31) supported by bearings (32), both the shaft (31) and the bearings (32) being inside the tank (1). To prevent interaction of the water of the tank (1) with the bearings (32) and the grease thereof, the tank (1) comprises sealed compartments (33) accessible from the outside by means of covers (34) and sealing gaskets (35) in which the bearings (32) are housed once the shafts (31) are assembled. Operation is thereby improved and the duration of the bearings (32) is increased, as well as preventing the water of the tank (1) from being contaminated by the grease from the bearings (32).

The separator of the invention, in particular the tank (1), can be sized to allow being transferred to the place where the waste material is produced, for example to a work or construction site, in the event of rubble, or it can have larger dimensions and be located in a separation facility to which waste material is brought from different localizations. In the first case, the tank (1) can incorporate a grip (36), for example a bar that is slightly curved upwards in its central part to allow a crane to lift it or tow it to mount it in a transport vehicle.

Transport of the separator can be simplified if the automatic feed means (18, 37) comprise, as an alternative to the double screen (18), a vibrating feed element (37) of lower height which facilitates the distribution and entry of previously screened waste material into the waste material chute (16). The vibrating feed element (37) is transportable and therefore can be readily coupled to recycling processes in line with other machines.

The invention claimed is:

1. A density separator for waste material, comprising:
- a tank for receiving waste material and intended for containing a fluid to separate waste material by density into floating waste material and settled waste material;
- automatic feed elements configured to feed waste material to the tank;
- motorised conveyor belts, each one with a chassis and a conveyor belt, to remove waste material from the tank; and comprising:
  - a floating waste material conveyor to extract floating waste material from the surface of the water; and
  - a settled waste material conveyor to extract settled waste material from the bottom of the tank;
- a blower sorting device, comprising:
  - an air turbine provides an airflow;
  - a duct which receives the airflow from the turbine and branches into a riser duct and a discharge duct; and
  - a diffuser located below the automatic feed elements and communicated with the riser duct to receive a first part of the airflow of the turbine and cause air to be expelled in the vertical or inclined direction, which raises light-weight waste material;
- where the discharge duct transports a second part of the airflow, which causes air to be horizontally expelled to remove the light-weight waste material, once it is raised by the first flow, to a lateral pipe, preventing interferences with other heavier fractions of waste material.

2. The separator of claim 1, further comprising a control element assembled in the duct to control the airflow circulating through the duct, as well as the rate of said total flow which is diverted to the first part and to the second part.

3. The separator of claim 1, further comprising a waste material chute sandwiched between the automatic feed elements and the tank.

4. The separator of claim 3, wherein the at least one injector is supported in one or several supports emerging from the waste material chute.

5. The separator of claim 3, wherein the bubble-making elements comprise at least one injector inside the tank to provide pressure and direction to the bubbles.

6. The separator of claim 1, further comprising bubble-making elements to bubble air inside the tank.

7. The separator of claim 6, wherein the bubble-making elements comprise at least one injector inside the tank to provide pressure and direction to the bubbles.

8. The separator of claim 7, wherein the at least one injector is assembled in an injection tube, oriented along the width of the tank.

9. The separator of claim 1, further comprising a bottom cleaner, which in turn comprises:

a first worm screw which runs at the bottom of the tank, collecting waste material; and a second worm screw installed outside the tank and inclined to receive in the lower portion the waste material from the first worm screw and raise said waste material for its subsequent disposal;

both the first worm screw and the second worm screw comprising a casing and at least one coaxially rotational vane with certain clearance with respect to the casing to allow draining water from the waste material.

10. The separator of claim 9, wherein the vane or vanes of at least one of the worm screws is devoid of a physical shaft.

11. The separator of claim 1, wherein the floating waste material conveyor additionally comprises:

brushes projecting from the conveyor belt to clean the wall of the tank and to retain the floating material; and a retainer assembled in the chassis contacting with the brushes upon passage thereof to extract impurities from the brushes out of the tank.

12. The separator of claim 1, wherein the conveyor belts incorporate a shaft supported by bearings, both the shaft and the bearings being inside the tank, and the tank comprises sealed compartments accessible from the outside, through covers and sealing gaskets in which the bearings are housed once the shafts are assembled.

13. The separator of claim 1, wherein the screening elements comprise a screen which is a double screen and comprises:

a vibrating upper tray to retain larger-sized waste material; and a vibrating lower tray, to retain intermediate-sized waste material and to allow smaller-sized waste material to pass through.

14. The separator of claim 13, further comprising a non-motorised lateral conveyor to laterally remove by gravity the larger-sized waste material retained in the vibrating upper tray of the screen.

15. The separator of claim 13, further comprising:

a fines collector which collects finer-sized waste material going through the vibrating lower tray; and a fines belt which receives the fines waste material from the fines collector.

16. The separator of claim 13, further comprising a feed conveyor to remove intermediate-sized waste material retained in the lower tray, to the tank.

17. The separator of claim 13, further comprising:

a fines collector which collects finer-sized waste material of the kind of grit, fines and sludge going through the lower tray; and a fines belt which receives the fines waste material from the fines collector.

18. The separator of claim 1, wherein the automatic feed elements comprise a vibrating feed element to allow entry into the tank of waste material previously screened.

19. The separator of claim 1, wherein the tank additionally comprises a grip to allow lifting or towing the tank.

20. The separator of claim 19, wherein the grip comprises a bar that is curved upwards in its central part.

* * * * *